United States Patent [19]

Grafinger et al.

[11] 3,940,765

[45] Feb. 24, 1976

[54] ARRANGEMENT FOR A PASSIVE RESPONDER FOR A POSITION FINDING SYSTEM

[75] Inventors: Wilhelm Grafinger; Lutz Knabe, both of Munich; Guenter Engelmann, Erkerode; Kurt Wagenlehner, Munich, all of Germany

[73] Assignee: Siemens Aktiengesellschaft, Berlin and Munich, Germany

[22] Filed: May 9, 1974

[21] Appl. No.: 468,389

[30] Foreign Application Priority Data

May 14, 1973 Germany ..... 2324339

[52] U.S. Cl. ..... 343/6.8 R; 246/122 R; 343/6.5 SS; 343/18 B

[51] Int. Cl.[2] ..... G01S 9/56; B61L 25/00

[58] Field of Search ..... 343/6.5 SS, 6.8 R, 18 B; 246/DIG. 1, 122 R

[56] References Cited

UNITED STATES PATENTS

| | | | |
|---|---|---|---|
| 3,210,539 | 10/1965 | Malaquin | 246/122 R |
| 3,247,509 | 4/1966 | Hamann et al. | 343/6.5 SS |
| 3,406,391 | 10/1968 | LeVon, Jr. | 343/6.5 SS |
| 3,886,548 | 5/1975 | Majeau et al. | 343/6.8 R |

*Primary Examiner*—Maynard R. Wilbur
*Assistant Examiner*—Richard E. Berger
*Attorney, Agent, or Firm*—Hill, Gross, Simpson, Van Santen, Steadman, Chiara & Simpson

[57] ABSTRACT

This invention relates in general to a passive responder of a position finding system including at least one microwave antenna and a resonator body. The resonator body is mounted adjacent the rail of a railroad track and is connected to a microwave antenna which points upwardly such that it receives radiation from a transmitter carried by the train. The radiation opening of the receiving antenna is adjacent the rail head and the antenna is covered with a cover member comprising dielectric material which comes into contact with the wheel as each wheel rolls past. The contact of the wheel with the dielectric cover assures that ice, snow, and other foreign material will be continuously cleared from the receiving antenna so as to assure optimum operation of the transponder.

10 Claims, 6 Drawing Figures

21
2
22
34
3
31
32
11
12
1
13

ARRANGEMENT FOR A PASSIVE RESPONDER FOR A POSITION FINDING SYSTEM

BACKGROUND OF THE INVENTION

1. Field of the Invention

This invention relates in general to passive responders for position finding systems which comprise at least one microwave antenna and a resonator member and forming a part of a position locating system wherein interrogation signals are transmitted by the train as it passes so as to interrogate and receive a signal from the passive responder as the railway vehicle moves by.

2. Description of the prior Art

Position finding systems comprise interrogators which utilize a given frequency band located in the microwave zone and which periodically emit interrogation signals which are changed in frequency as the railroad vehicle passes passive responders mounted along the railway track. Coded information is stored in the responders by means of tuned resonators which information is received by the interrogating units on the moving train by means of frequency selective reflection. This information may include fixed data about distances from fixed reference points and may also include variable data relating, for example, to travel orders.

There are many ways in which the responders can be arranged along the railway. They might, for example, be mounted above the railway as for example on overhead contact wire terminations or on poles in such a way that the main direction of radiation of the antenna is pointed downwardly. In such an arrangement the antenna cover of the antenna on the moving vehicle can be heated. In this fashion and due to the air flow, the antennas of the responders and the interrogating units can be kept free of snow. Very wet snow dampens the transmission path so much that positive transmission between the position finding devices is degradated to a point where proper operation is not assured. For reasons which need not be explained here, the arrangement of such overhead transponding units is not feasible for technical reasons.

Another arrangement would be to mount the responders on posts located at the side of the railway such that the main direction of radiation of the antennas would always be pointed horizontally toward passing vehicles. In such an arrangement although small amounts of snow may adhere to the antennas, generally wet snow would fall from the antenna due to its heavy weight. However, such an arrangement is not usable under actual railway conditions due to weather factors.

The only approved method of mounting the responders is to mount them in or at the tracks in the gravel of the road bed or on the railroad ties. With such mounting, the antennas of the transponders are pointed directly upward, however, such arrangement allows the transmission path between the responders and interrogators to be destroyed due to heavy snow cover which is maximum with such arrangement.

SUMMARY OF THE INVENTION

The present invention solves the problem caused by snow cover which destroys the transmission path between an interrogator and a responder in a position finding system, wherein the responder includes at least one microwave antenna and a resonator member which provides information concerning the location of the responder to an interrogator mounted on a railway vehicle by means of high frequency radiation. The present invention also assures that the transmission between responders and interrogators will not be significantly impaired by wet snow or ice.

Accordingly, it is an object of the present invention to solve the problem wherein the responder is mounted near the rail with the microwave antenna pointing upwardly with its receiving and radiating opening in immediate proximity of the head of the rail and wherein the antenna opening is covered with a cover member comprising a dielectric material which does not interfere with the radiation and which is contacted by the wheel as the vehicle moves passed.

In further developments of the invention, the following features may be employed advantageously either individually or in combination with each other. For example, the responder or transponder may be located on the inside of the rail. The responder or transponder may be also located on the outside of the rail. In this application, the inside and the outside of the rail refers to that side of the rail toward the other rail of the track and the side of the rail which is away from the other rail of the track, respectively. The antenna cover member may consist of a block of harder soft elastic dielectric synthetic block material. The cover member may also comprise a dome of soft elastic synthetic material which has at least the general shape of a spherical segment. The cover member may consist of a combination of a block of soft elastic dielectric material with a dome of soft elastic dielectric material having the general shape of a spherical segment.

The resonator member may be spatially separated from the antenna and may be mounted below the foot of the rail and may be connected to the antenna by a flexible high frequency line.

The resonator member may be mounted in a position in which the longitudinal axes of the resonators are each perpendicular to the plane of the track.

The resonator member may have a wave guide with a rectangular cross section which extends to an upper wall and a plurality of resonators may be coupled to the wave guide and the antenna can be connected to the resonator member by way of at least one hollow curved transmission line which is matched high frequencywise. With such an arrangement, the resonator member may be mounted on the rail web and the longitudinal axis of the wave guide may extend in the direction of the rails.

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
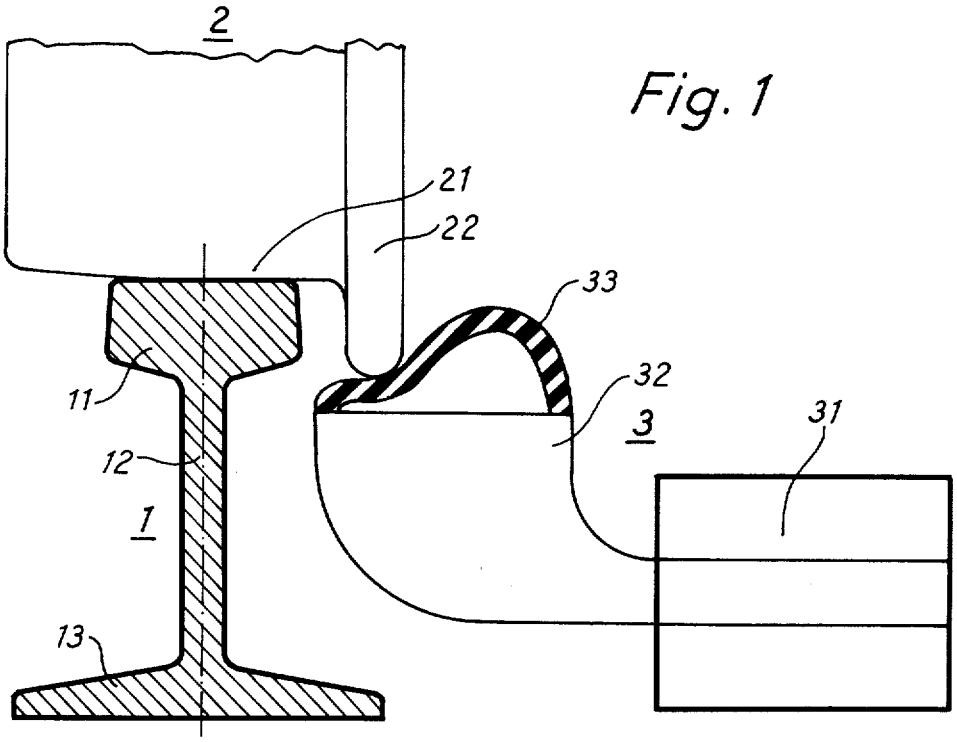
FIG. 1 illustrates schematically a sectional view of a responder having a dome-shaped cover member mounted on the inside of a rail of the track.

FIG. 1 illustrates a rail 1 having a head 11 and a web 12 and a base 13 over which railroad wheels 2 pass. The lower portion of the railway wheel 2 is shown and consists of a tire 21 and a flange 22. The responder 3 of a position finding system is mounted so as to be engaged by the flange 22 of the wheel and consists of a resonator member 31 to which is attached a microwave antenna 32 which in the specific example illustrated in FIG. 1 comprises a horn antenna. A flexible cover member 33 is mounted over the upwardly extending end of the antenna horn 32 and is formed of a dielectric material which is flexible as shown in the figure such that when the flange 22 engages it, it can deform to allow the wheel to pass without injuring the antenna or the resonator.

In FIG. 1 the responder 3 is mounted on the inside portion of the rail 1, or in other words, it is mounted between the two rails and adjacent one of the rails. The antenna 32 points upwardly and is covered and closed by the cover member comprising the flexible dome 33 made of synthetic material. The cover or dome 33 may comprise soft elastic synthetic material which will be depressed by the flange 22 as the wheel passes by the horn 32. After the flange of the wheel has passed the synthetic dome 33, it will, of course, rebound to its approximately hemispherical shape. Snow, ice, or other foreign material that might be on the surface of the cover member 33 will be thrown off by the rebound action as it moves after the flange 22 has moved out of engagement with it.

Figure 1A:
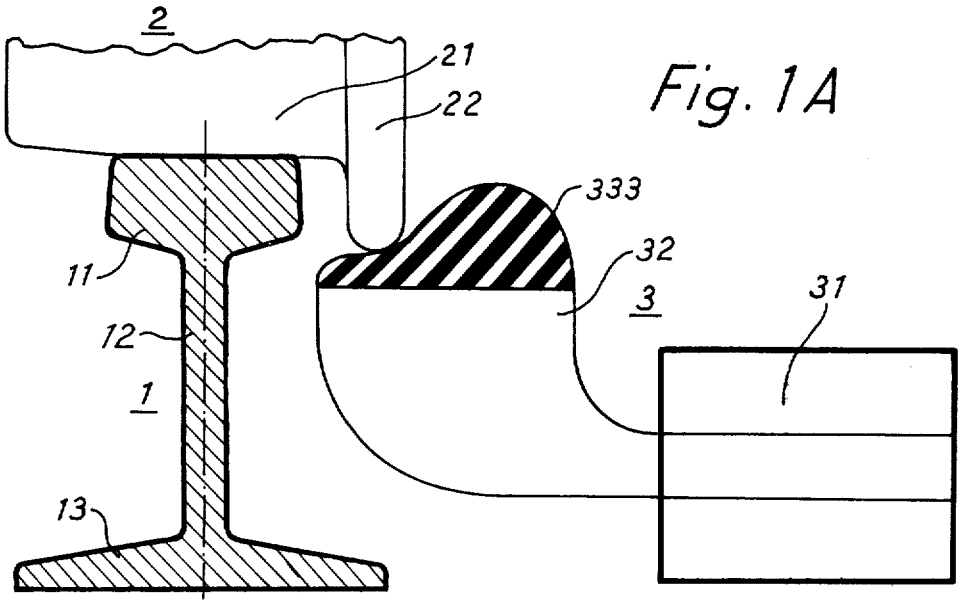
FIG. 1A illustrates a responder having a solid dome-shaped cover member mounted on the inside of a rail.

FIG. 1A illustrates a modification of the invention, wherein all of the parts are the same as in FIG. 1 except the cover member, instead of being a relatively thin hemispherical dome-shape member, is formed to be of solid soft elastic synthetic material 333. The relatively thick dome-shape member 333 illustrated in FIG. 1A serves the same purpose as the dome 33 in FIG. 1 in that it protects and prevents ice and snow and other foreign materials from passing down into the antenna 32 and also it is depressed by the flange 22 of the wheel and rebounds to its original shape after the flange has passed thus clearing and freeing the dome-shape member 333 of ice and snow.

Figure 2:
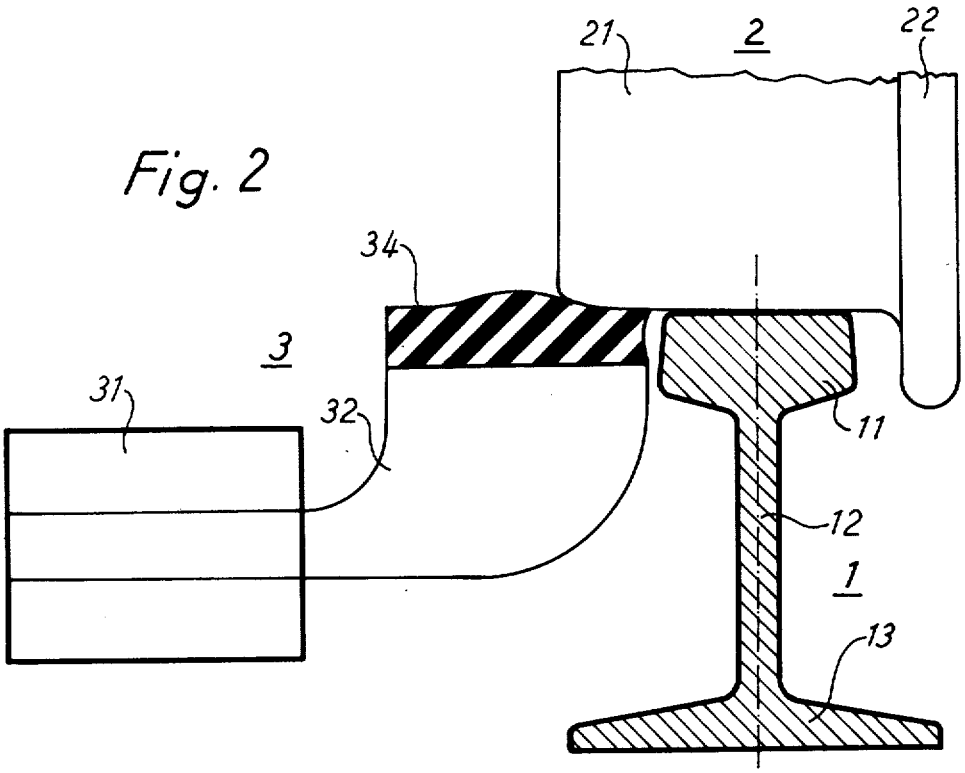
FIG. 2 illustrates schematically a sectional view wherein the responder has a soft elastic cover member and is mounted on the outside of a rail.

FIG. 2 illustrates a modification of the invention wherein the resonator member 31 and antenna horn 32 are mounted on the outer side of the rail that is the side of the rail 1 which is opposite to that where the flange 22 passes. In the embodiment illustrated in FIG. 2, the upper opening of the antenna 32 is covered by soft elastic synthetic block 34 which has an upper surface which is engaged by the tire 21 of the wheel 2 such that the block 34 is slightly deformed as the wheel 2 passes thereby thus clearing and freeing the antenna opening which is covered by the block 34 as the wheel passes.

Figure 3:
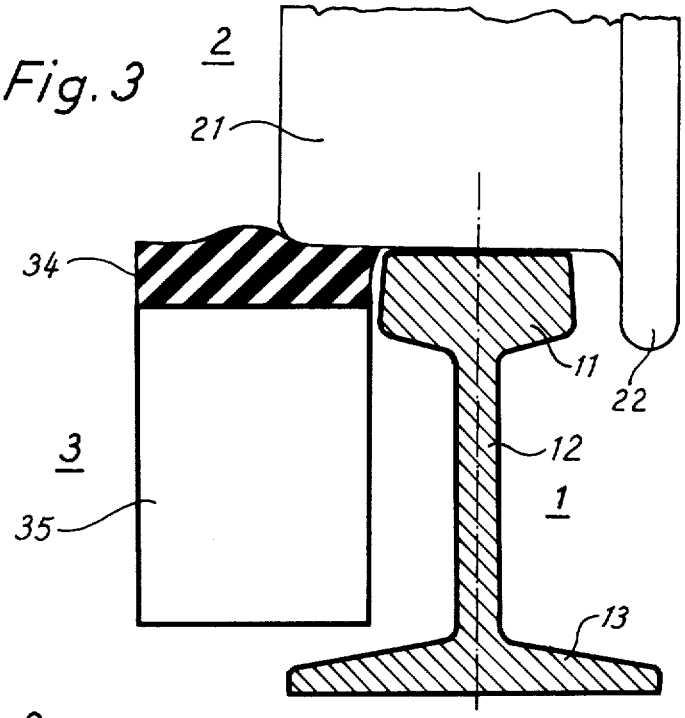
FIG. 3 illustrates a further modification of the invention with the responder having a soft elastic cover member with the transponder mounted on the outside of a rail.
Figure 4:
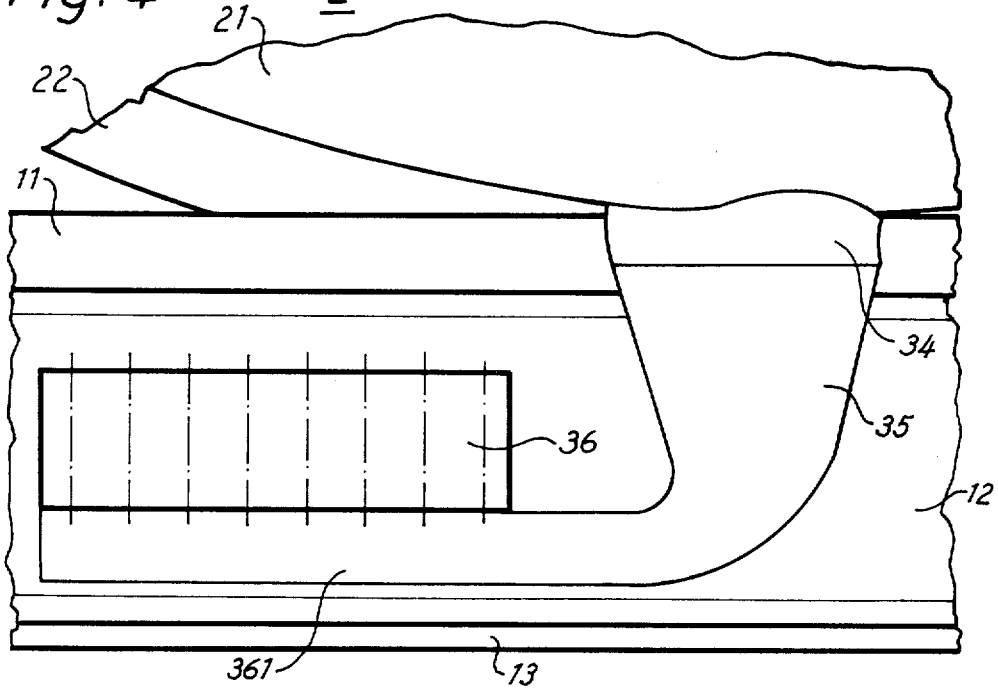
FIG. 4 is a partially cut-away view illustrating the responder shown in FIG. 3.

FIGS. 3 and 4 illustrate another embodiment of the invention with FIG. 3 being a sectional view through the rail 1, and wherein the responder 3 is mounted on the outside of the track as in FIG. 2. However, the responder 3 is formed such that its resonator member 36 illustrated in FIG. 4 extends in the direction of the rails with the longitudinal axis of its wave guide 361 illustrated in FIG. 4 extending in the direction of the rail 1 and being mounted on the web 12 of the rail by suitable attaching means. The resonator member 36 is mounted above the wave guide 361 which connects to the antenna horn 35 which is covered by a block 34 consisting of soft elastic synthetic material. The tire 21 of the wheel 2 engages the block 34 to deform it slightly as the tire 21 of each wheel rolls past thus freeing it of ice and snow.

Figure 5:
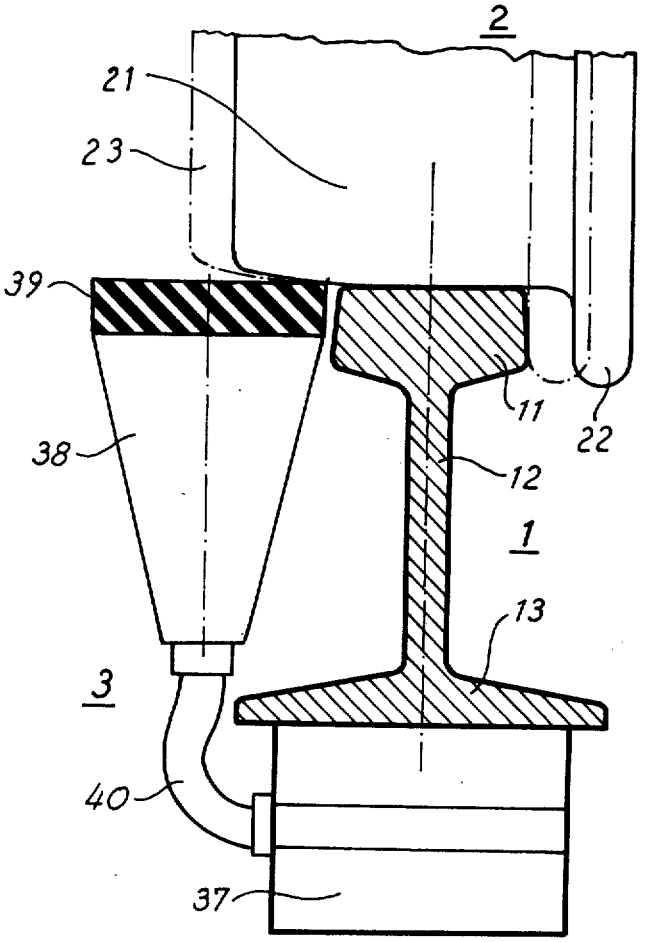
FIG. 5 is a sectional view illustrating a member separated from the antenna and mounted below the base of the rail and with the antenna having a cover member which engages the wheel and being mounted on the outside of the track.

FIG. 5 illustrates a further modification of the invention, wherein the responder 3 consists of a resonator member 37 which is spatially separated from the antenna 38 and is connected thereto by a flexible high frequency line 40. The resonator member 40 is mounted below the base 13 of the rail 1 in an appropriate fashion. The opening of the antenna 38 is covered by a hard synthetic block 39 against which the tire 21 of the wheel engages so as to clean it of ice and snow. However due to the block 39, the tire 21 does not push the antenna 38 down sufficiently to injure since the block 39 will wear with the railhead 11 and the antenna 38 will not be damaged.

Thus, by mounting the antenna 38 and the block 39 on the outside of the rail, the top of the antenna 38 can extend higher than where it is mounted on the inside of the rail due to the flange 22 on the wheel which extends below the upper surface of the railhead 11. It is to be realized, of course, that the embodiments wherein the antenna is mounted on the outside of the rail can also be closed by soft elastic synthetic blocks such as block 34 and such synthetic blocks should be mounted so that they protrude slightly above the upper edge of the rail such that it wears with the head of the rail and the tire 21 engages it. On the other hand, if the antenna 38 is mounted on the inside of the rail, the antenna should be adjusted so that the cover member extends slightly higher than the flange 22 of the wheel so that the flange depresses it slightly to clean it as the wheel 2 passes by the cover member.

The position and manner of mounting the responder is not the primary subject of the invention. For example, the answering device may be mounted on the inside of the track as well as at the outside of the track on a tie. However, it is possible, as discussed above, to mount the responder directly or indirectly on the rail web or below the rail base. The antenna of the responder may be covered with snow and the invention will provide that an area which is exposed will be at least partially cleaned by the wheel or flange so as to allow proper operation of the antenna and the responder. In order to assure transmission, only a partially exposed area is required for proper operation of the antenna. Since the wheels of the vehicle pass freely back and forth on the rails, it is assured that at least a partial area which will be sufficient to assure transmission will be exposed by the contact of the wheels or the wheel flanges with the cover member, and thus, the antenna of the responder will be kept clear of ice and snow. It is also possible to improve the characteristic of the antenna of the responding device in an efficient manner by the use of a cover member consisting of a dielectric material.

Although it has been described with respect to preferred embodiments, it is not to be so limited as changes and modifications may be made which are within the full intended scope as defined by the appended claims.

We claim as our invention:

1. A passive responder for a position locating system for a wheeled railway vehicle moving on a track and in which said vehicle carries a microwave transmitter and receiver and transmits an interrogation signal to said passive responder the improvement wherein said responder includes a resonator member with several resonators which is mounted in the proximity of a rail of the track, a microwave antenna forming a part of said responder and pointed upwardly with its reciving and radiation opening in immediate proximity to the head of the rail, and a cover member of a dielectric material covering the upper end of said antenna and mounted so that it is engaged by the wheels of said vehicle as they roll by the responder on the rail.

2. An arrangement according to claim 1, wherein said responder is mounted on the inside side of the rail between the tracks.

3. An arrangement according to claim 1, wherein said responder is mounted on the outside side of the rail.

4. An arrangement according to claim 1, wherein said cover member consists of a hard synthetic block.

5. An arrangement according to claim 1, wherein said cover member consists of a soft elastic synthetic block.

6. An arrangement according to claim 1, wherein said cover member consists of a soft elastic synthetic dome which has at least approximately the form of a segment of a sphere.

7. An arrangement according to claim 1, wherein said cover member consists of a combination of a soft elastic synthetic block and a soft elastic dome which has at least approximately the form of a segment of a sphere.

8. An arrangement according to claim 1, wherein said resonator member is spatially separated from the antenna and mounted below the base of the rail and is connected to the antenna by means of a flexible high frequency line.

9. An arrangement according to claim 1, wherein said resonator member is mounted in a position such that the respective longitudinal axes of the resonator member extend perpendicular to the plane of the track.

10. An arrangement according to claim 7 wherein said resonator member includes a wave guide with rectangular cross section and with an upper wall to which vertically extending resonators of the member are coupled, said antenna connected to said resonator member via at least one hollow bend which is formed to match high frequencies, and said resonator member mounted to the web of the rail with the longitudinal axis of the wave guide extending in the direction of the rails.

* * * * *